US005984813A

United States Patent [19]

Cinnella

[11] Patent Number: 5,984,813

[45] Date of Patent: Nov. 16, 1999

[54] INSTRUCTIONAL BASEBALL

[75] Inventor: Douglas W. Cinnella, 64 Edgemere Ave., Greenwood Lake, N.Y. 10925

[73] Assignee: Douglas W. Cinnella, Greenwood Lake, N.Y.

[21] Appl. No.: 08/938,094

[22] Filed: Sep. 26, 1997

[51] Int. Cl.[6] ..... A63B 39/08

[52] U.S. Cl. ..... 473/613

[58] Field of Search ..... 473/595, 596, 473/597, 598, 600, 601, 602, 613, 615, 451; D21/713

[56] References Cited

U.S. PATENT DOCUMENTS

| | | | |
|---|---|---|---|
| D. 288,461 | 2/1987 | Hirai | D21/713 |
| D. 288,462 | 2/1987 | Hirai | D21/713 |
| D. 401,605 | 11/1998 | Shirley | D21/713 |
| 2,448,731 | 9/1948 | Park . | |
| 4,128,238 | 12/1978 | Newcomb et al. | 473/451 |
| 4,772,019 | 9/1988 | Morgan | 473/601 |
| 4,874,169 | 10/1989 | Litchfield | 473/613 |
| 5,033,743 | 7/1991 | Wright | 473/613 |
| 5,048,829 | 9/1991 | Prokupek . | |
| 5,067,719 | 11/1991 | Mook . | |
| 5,280,906 | 1/1994 | Vitale | 473/613 |
| 5,472,187 | 12/1995 | Kempf . | |
| 5,711,725 | 1/1998 | Bengtson | 473/451 |

FOREIGN PATENT DOCUMENTS

| | | | |
|---|---|---|---|
| 2145630 | 4/1985 | United Kingdom | A63B 37/14 |

OTHER PUBLICATIONS

Keese, Parton, "Breaking Pitches Made Easy," *New York Times* Apr. 17, 1978, p. C. 14.

Catalog advertisement featuring "Radar Ball," p. 93; Sep., 1997.

*Primary Examiner*—Steven Wong

*Attorney, Agent, or Firm*—Baker & Botts, L.L.P.

[57] ABSTRACT

An instructional baseball for teaching the proper manner of throwing a curveball. The instructional baseball comprises a generally spherical ball having a continuous seam on the surface, said seam defining a horseshoe-shaped boundary for each of four areas on the surface of the ball, and a depression within each of the areas, each of the depressions having substantially the same volume.

9 Claims, 2 Drawing Sheets

INSTRUCTIONAL BASEBALL

BACKGROUND OF INVENTION

The present invention relates to the game of baseball, and, in particular, the instruction of the pitch known as the "curveball."

In baseball, a pitcher will use whatever means necessary to deceive a hitter, including, but not limited to, making the pitched ball sink or drop. This pitch is frequently referred to as the "curveball." Different trajectories can be achieved by altering the grips on the ball, as well as applying different points of pressure with the fingers. In order to learn and master the curveball, one should understand some of the basic principles of baseball aerodynamics.

When released from the hand, the ball will, naturally, spin, and its path will be affected by wind currents. The actual trajectory of the ball will depend on the seams of the ball and, specifically, in what direction they are spinning. Without intending to be bound by any theory, it is believed that, while in flight, the seams of a spinning ball will grab the air and pull the air underneath the ball, much like the air foil on an airplane. Thus, the faster the seam-spin, the greater the air-flow, and the more pronounced the trajectory of the ball.

A fastball, the easiest and most natural pitch, is released directly off the finger tips, without any added pressure or alterations. The result is a backspin of the seams and a straight ball trajectory. The curveball requires a different skill. To effectively throw this pitch, one must make the seams rotate in the opposite direction as the fastball. In other words, the ball must have topspin. Spinning in such a manner, it is believed that the seams will grab the air, force it beneath the ball and thus make the ball drop on its way towards the batter. In order to effectuate this air flow, a pitcher must manually create the forward rotation. He can do this by facing his middle and index fingers toward the batter and snapping his wrist downward—as if pulling down a window shade—upon release of the ball. Depending on how fast the seams are spinning, indeed how hard the pitcher has snapped his wrist downward, the ball will break in a downward manner. In attempting to throw a curveball, however, beginners will often attempt to throw a pitch that breaks in a horizontal, rather than vertical, plane by facing the middle and index fingers away from the body and twisting the wrist and forearm in an awkward manner upon release of the ball. This pitch, known as a "flat curve," if thrown regularly, can cause serious injury and should be avoided.

Although explaining the proper and improper methods of throwing a curveball is a relatively simple task, teaching a pitcher to actually throw the curveball is frequently a difficult, and, often, futile, endeavor. Until now, novice pitchers and coaches have had little, if any, ability to determine the reason or reasons why an attempted curveball does not drop. Heretofore, the best available educational tool in teaching the curveball was to observe the spin of the seams while the ball is in flight. This, however, is difficult, if not impossible, for a pitcher, since the ball is traveling away from him. And while a coach assuming the position of hitter may have a slightly easier time observing the spin of a pitched ball, the desired level of accuracy in determining the correctness of the rotation is often unattainable using the observation technique. Adding to the difficulty of determining the cause of an ineffective curveball is the fact that a curveball may be unsuccessful for reasons other than improper spin, such as too much velocity or an improper release point. Thus, there is a significant need for a tool which would allow a pitcher or coach to determine whether the problem with an unsuccessful curveball lies in the spin or elsewhere in the delivery.

Accordingly, it is an object of the present invention to provide a means to identify and perfect the correct spin of a curveball. Another object of this invention is to provide a means of enhancing and exaggerating the trajectory of a curveball in order to observe an otherwise indiscernible break or curve. Another object of this invention is to provide an educational and instructional tool which can be safely used at any level of competition from approximately the age of 13. Yet another object of this invention is to accomplish the foregoing objectives by a means which can be used repeatedly, by any number of students.

SUMMARY OF THE INVENTION

The desired objectives are achieved by the present invention in which a depression is created in each of the four areas defined by the horseshoe-shaped boundaries formed by the seam of the covering of a regulation baseball. In a preferred embodiment, the depressions are a color which contrasts with the color of the remaining surface area of the baseball.

DESCRIPTION OF THE DRAWINGS

Other objects, features and advantages of the invention will become apparent and its construction and operation better understood, from the following detailed description when read in conjunction with the accompanying drawings, in which:

in FIG. 4.

DESCRIPTION OF PREFERRED EMBODIMENTS

Figure 1:
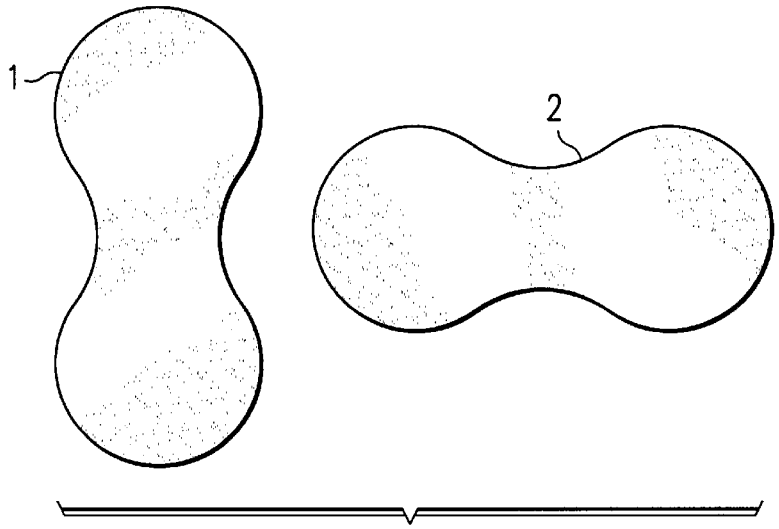
FIG. 1 (PRIOR ART)
FIG. 1 is a plan view of the covering material of a regulation baseball.
Figure 2:
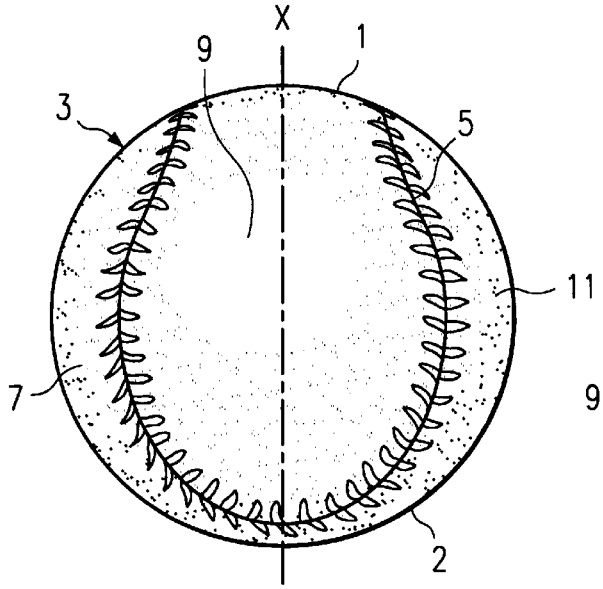
FIG. 2 (PRIOR ART)
FIG. 2 is a side elevation view of a regulation baseball.
Figure 3:
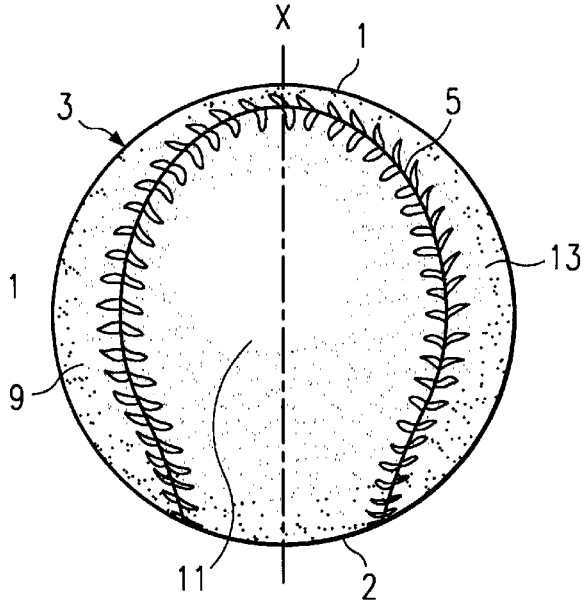
FIG. 3 (PRIOR ART)
FIG. 3 is a side elevation view of the regulation baseball shown in FIG. 1 looking at the baseball from the right.

Referring first to FIG. 1, there are depicted two identical figure-eight-shaped pieces of horsehide 1, 2 which comprise the cover of a regulation baseball. FIGS. 2 and 3 depict a regulation baseball 3, FIG. 3 being a view from the right of the baseball 3 shown in FIG. 2. In FIGS. 2 and 3, the figure-eight-shaped pieces of horsehide 1, 2 are stitched together in an interlocking complementary arrangement such that the resultant seam 5 on the surface of the baseball is continuous and defines a horseshoe-shaped boundary for each of four adjacent areas 7, 9, 11, 13 on the baseball surface each of which has an orientation with respect to axis x which is opposite the orientation of the adjacent areas, e.g., the open end of the horseshoe-shaped boundary of area 9 is facing the opposite direction of the open ends of the respective horseshoe-shaped boundaries of areas 7 and 11.

Figure 4:
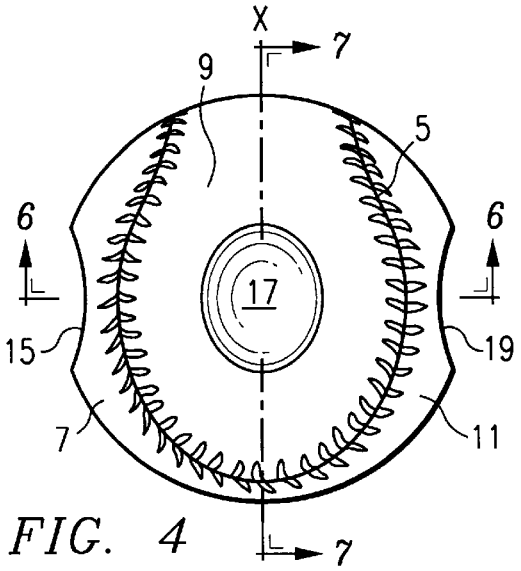
FIG. 4 is a side elevation view of an embodiment of the present invention.
Figure 5:
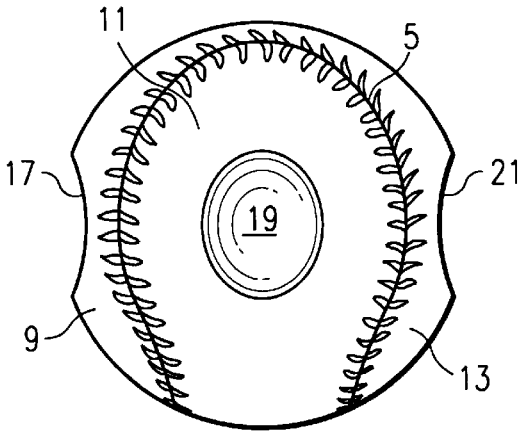
FIG. 5 is a side elevation view of the embodiment of the present invention shown in FIG. 4 looking at the present invention from the right.

FIGS. 4 through 7 depict an embodiment of the present invention. In FIGS. 4 and 5, the baseball 3 is substantially the same as the baseball 3 depicted in FIGS. 2 and 3 with the additional feature of depressions 15, 17, 19, 21 within each of areas 7, 9, 11, 13, respectively. When a curveball is thrown, it is believed, the depressions will force under the ball a mass of air greater than that normally forced under the ball by the seams, thus resulting in an exaggerated break. The advantage of the exaggeration is two-fold: First, the pitcher and coach can be confident that the pitcher has imparted the proper spin which, due to other deficiencies in pitching mechanics, may not have otherwise resulted in a curved trajectory. Second, the pitcher will become encouraged to continue working on developing a curveball having received tangible positive feedback.

Returning now to FIGS. 4 and 5, depressions 15, 17, 19, 21 may be formed by removing portions of a regulation baseball covering and the underlying materials. In order to create a consistent texture which will have a smooth, natural feel to the fingers, the removed cover portions may be replaced with a properly-sized covering of the same material, e.g., horsehide, thus enabling the pitcher to throw the ball without the distraction of varying surface textures. In order to further minimize any perceptible difference between throwing a regulation baseball and throwing the present invention, the baseball 3 of the present invention may be constructed from materials having a density greater than that of the materials from which a regulation baseball is constructed such that the weight of the invention is the same as the weight of a regulation baseball.

Figure 6:
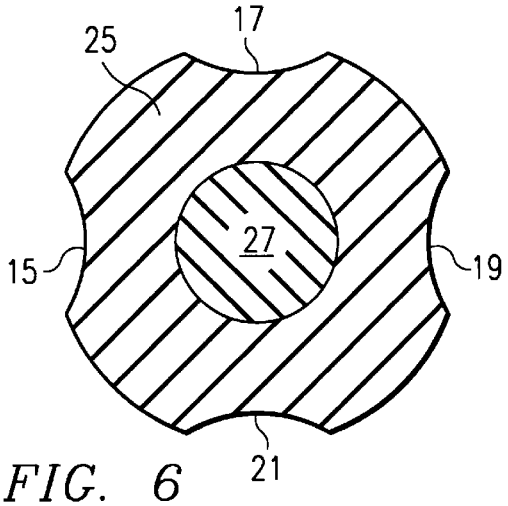
FIG. 6 is a cross-sectional view of the embodiment of the present invention shown in FIG. 4 looking at the present invention from the bottom.
Figure 7:
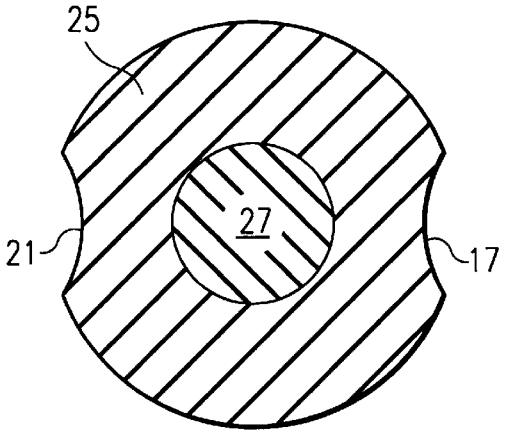
FIG. 7 is a cross-sectional view of the embodiment of the present invention shown

As shown in FIGS. 4 and 5, each depression 15, 17, 19 and 21 is convex and generally oval in shape. Good results have been demonstrated with convex depressions, each having a width of approximately 1 ⅜ths inches, a length of approximately 2 inches and a depth of approximately 7/16ths of an inch at its deepest point. The precise shape and dimensions of the depressions, however, are not critical to the invention and may be varied in accordance with the amount of trajectory exaggeration desired. Generally, the larger the volume of the depression is, the greater the trajectory exaggeration will be. It is believed that a minimum diameter for a generally circular depression in order to have a noticeable effect on the trajectory of the ball is approximately ½ of an inch. The maximum diameter will be determined by the size which will permit a pitcher to grip the ball along the seams without significant interference from a depression. Regardless of the shape and dimensions of the depressions, it is important to the invention that the volume of each of the depressions is substantially equal to one another in order to ensure that any observed curve in trajectory is the product of a proper spin and not due to an inequality in the amount of air forced under the ball by the respective depressions. This symmetry is shown in FIGS. 6 and 7, top and side cross-sectional views of the invention, respectively. From these views, the construction of the invention as it relates to the construction of a regulation baseball is apparent. Depressions 15, 17, 19, 21 extend into the string and yarn 25 which surrounds the core 27 of the baseball.

While the discussion hereinabove has been with respect to the invention as it relates to a regulation baseball, it is not necessary to alter a regulation baseball in order to practice the invention. Since the invention is not intended to be used in a regulation game, it may be made from any number of materials of appropriate density and weight, such as those plastics from which practice balls are currently made, and may be shaped using any number of manufacturing methods including, but not limited to, injection molding. Similarly, where a horsehide cover is utilized, which it need not be if a simulated seam (which is considered a seam for purposes of this invention) is supplied, the cover need not be an altered regulation baseball cover, but may have preformed areas which fit into and over the depressions when sewn on.

An additional advantage of the present invention may be realized by coloring the depressed areas with a color which contrasts with the color of the remainder of the ball. When a proper curveball is thrown, each of the color-contrasted areas will rotate in the same vertical, or nearly vertical, plane, thus forming a visible "ring" and providing another indication of a properly thrown curveball. If a ring is produced in a horizontal, or nearly horizontal, plane, a coach can immediately instruct the pitcher on the dangers of the "flat curve." This color scheme may also be used on an otherwise unmodified regulation or simulated regulation baseball in order to determine proper rotation.

Figure 8:
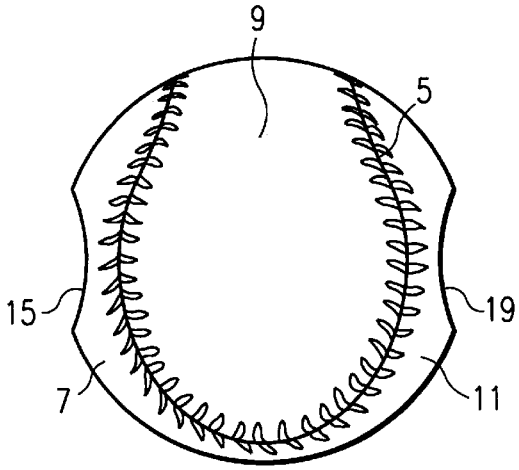
FIG. 8 is a side elevation view of a second embodiment of the present invention.
Figure 9:
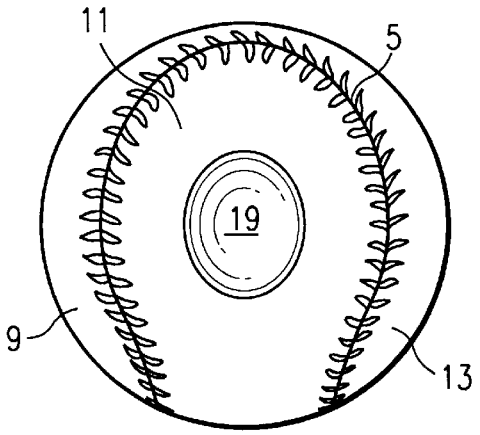
FIG. 9 is a side elevation view of the second embodiment of the present invention shown in FIG. 8 looking at the present invention from the right.

While the above is a description of the invention in its preferred embodiments, various modifications, alternate constructions and equivalents may be employed, only some of which have been described above. For example, in view of the principles of baseball aerodynamics and the need for symmetry in the invention as discussed above, one skilled in the art will appreciate that acceptable results can be obtained if depressions of suitable dimensions are provided in only two non-adjacent areas of the four areas defined by the horseshoe-shaped boundaries formed by the seam of the covering of a regulation baseball. This configuration of the present invention is shown in FIGS. 8 and 9, wherein nonadjacent areas 7 and 11 have depressions 15 and 19, respectively, and nonadjacent areas 9 and 13 have no depressions. Therefore, the above description and illustration should not be taken as limiting the scope of the invention which is defined by the appended claims.

I claim:

1. An instructional device for teaching the proper manner of the throwing of a curveball, said proper manner comprising throwing the ball with a topspin rotation in a substantially vertical plane, said instructional device comprising:

a generally spherical ball having a continuous seam on the surface of said ball, said seam defining a horseshoe-shaped boundary for each of four adjacent areas on the surface of said ball; and a depression within each of said areas, each of said depressions intersecting with the substantially vertical plane in which a properly thrown curveball will rotate and each of said depressions having substantially the same volume as one another, whereby a properly thrown curveball will exhibit an exaggerated trajectory not otherwise obtained.

2. The instructional device of claim 1 wherein the depressions are generally oval in shape.

3. The instructional device of claim 1 wherein the depressions are of a color which contrasts with the color of the remainder of the surface of the device, whereby a ring in said substantially vertical plane of rotation will be visible when a proper curveball is thrown.

4. An instructional baseball for teaching the proper manner of throwing a curveball, said proper manner comprising throwing the ball with a topspin rotation in a substantially vertical plane, said instructional device comprising:

a generally spherical interior section;

a cover comprising two figure-eight sections stitched together over said interior section forming a continuous seam, said seam defining a horseshoe-shaped boundary for each of four adjacent areas; and a depression within each of said areas, each of said depressions intersecting with the substantially vertical plane in which a properly thrown curveball will rotate and each of said depressions having substantially the same volume as one another, whereby a properly thrown curveball will exhibit an exaggerated trajectory not otherwise obtained.

5. The instructional baseball of claim 4 wherein the depressions are generally oval in shape.

6. The instructional baseball of claim 4 wherein the depressions are of a color which contrasts with the color of the remainder of the surface of the device, whereby a ring in said substantially vertical plane of rotation will be visible when a proper curveball is thrown.

7. An instructional device for teaching the proper manner of the throwing of a curveball, said proper manner comprising throwing the ball with a topspin rotation in a substantially vertical plane, said instructional device comprising:

a generally spherical ball having a continuous seam on the surface of said ball, said seam defining a horseshoe-shaped boundary for each of four adjacent areas on the surface of said ball; and a depression within each of two non-adjacent areas of said four areas, each of said depressions intersecting with the substantially vertical plane in which a properly thrown curveball will rotate and each of said depressions having substantially the same volume as one another, whereby a properly thrown curveball will exhibit an exaggerated trajectory not otherwise obtained.

8. The instructional device of claim 7 wherein the depressions are generally oval in shape.

9. The instructional device of claim 7 wherein the depressions are of a color which contrasts with the color of the remainder of the surface of the device, whereby a ring in said substantially vertical plane of rotation will be visible when a proper curveball is thrown.

* * * * *